US005759239A

United States Patent [19]

Yu

[11] Patent Number: 5,759,239

[45] Date of Patent: Jun. 2, 1998

[54] AIR PURIFIER

[76] Inventor: Chi-Chin Yu, No. 601, Pa Te Road, Sec. 4, Taipei, Taiwan

[21] Appl. No.: 852,376

[22] Filed: May 7, 1997

[51] Int. Cl.[6] ..... B03C 1/30

[52] U.S. Cl. ..... 96/3; 55/279; 96/16; 96/63; 96/68; 422/24; 422/121; D23/365

[58] Field of Search ..... 96/1, 3, 16, 55, 96/60–63, 65, 66, 59, 69, 80, 68; 55/279; 95/28, 78; 422/24, 121; D23/364, 365

[56] References Cited

U.S. PATENT DOCUMENTS

| | | | |
|---|---|---|---|
| 3,744,216 | 7/1973 | Halloran | 96/16 |
| 3,745,750 | 7/1973 | Arff | 55/279 X |
| 4,244,712 | 1/1981 | Tongret | 422/121 X |
| 5,034,032 | 7/1991 | Yikai et al. | 96/55 |
| 5,060,717 | 10/1991 | Morita et al. | 96/55 X |
| 5,185,015 | 2/1993 | Searle | 96/16 |
| 5,330,722 | 7/1994 | Pick et al. | 422/121 |
| 5,549,735 | 8/1996 | Coppom | 96/63 |
| 5,614,002 | 3/1997 | Chen | 96/55 |
| 5,616,172 | 4/1997 | Tuckerman et al. | 422/24 X |
| 5,632,806 | 5/1997 | Galassi | 96/63 X |

*Primary Examiner*—Richard L. Chiesa

*Attorney, Agent, or Firm*—Jacobson, Price, Holman & Stern, PLLC

[57] ABSTRACT

An air purifier including a housing which has two air intake passages at two lateral sides and an induced-draft fan in an air accumulation chamber between the air intake passages, a plurality of air filters respectively mounted between the air accumulation chamber and the air intake passages, each air filter including two electrically insulative frames fastened together, and a plurality of metal wire gauze filters, and a high-voltage static electricity generator mounted inside the housing and connected to one metal wire gauze filter, the high-voltage static electricity generator providing high-voltage positive static electricity to one metal wire gauze filters, causing the other metal wire gauze filters to produce positive static electricity at one side and negative static electricity at an opposite side for catching dust from air passing through.

17 Claims, 4 Drawing Sheets

AIR PURIFIER

BACKGROUND OF THE INVENTION

The present invention relates to an air purifier, and more particularly to a flat, compact air purifier which needs less installation space and, which when electrically connected produces positive and negative static charges to catch dust from air passing through.

Regular air purifiers commonly use wire gauze filter means to remove dust from air. However, this method does not achieve a satisfactory effect. Another drawback of regular air purifiers is that they are commonly heavy, and need much installation space. Further, regular buildings are of steel frame structure which shield the magnetic field of the earth, thereby causing the amount of indoor air energy to be greatly reduced.

SUMMARY OF THE INVENTION

The present invention has been accomplished under the circumstances in view. According to one aspect of the present invention, the air purifier comprises a housing which has two air intake passages at two lateral sides and an induced-draft fan in an air accumulation chamber between the air intake passages, a plurality of air filters respectively mounted between the air accumulation chamber and the air intake passages, each air filter including two electrically insulative frames fastened together, and a plurality of metal wire gauze filters, and a high-voltage static electricity generator mounted inside the housing and connected to one metal wire gauze filter, the high-voltage static electricity generator providing high-voltage positive static electricity to one metal wire gauze filters, causing the other metal wire gauze filters to produce positive static electricity at one side and negative static electricity at an opposite side for catching dust from air passing through. According to another aspect of the present invention, the housing has a flat structure which needs less installation space, and a face panel decorated with a design for example a painting. According to still another aspect of the present invention, a magnetic element and a sterilizing lamp are installed in the housing. When intake air passes through the air filters, the magnetic element produces magnetic lines of force that cut perpendicularly through the flowing flow of air, causing air to obtain energy, and at the same time the sterilizing lamp produces light to sterilize the flowing flow of air.

DETAILED DESCRIPTION OF THE PREFERRED EMBODIMENT

Figure 1:
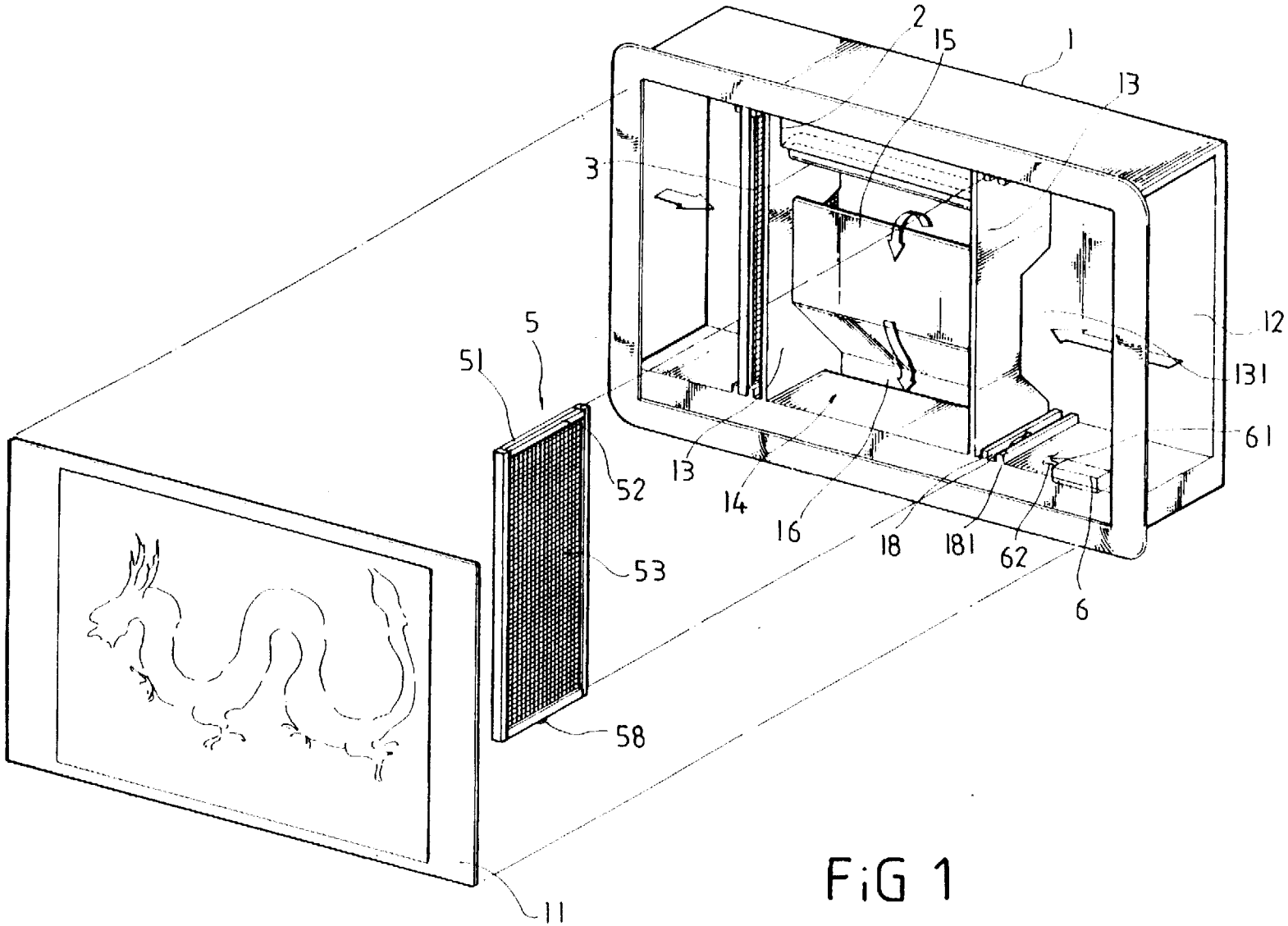
FIG. 1 is an exploded view of an air purifier according to the present invention.
Figure 2:
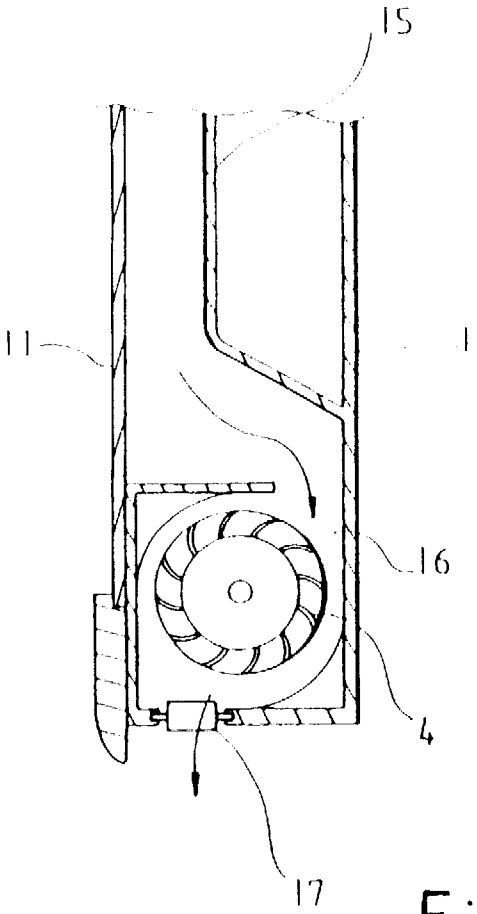
FIG. 2 is a sectional view of a part of the present invention, showing the induced-draft fan mounted in the air intake chamber.

Referring to FIGS. 1 and 2, an air purifier in accordance with the present invention comprises a flat housing 1. The face panel 11 of the housing 1 is decorated with a drawing.

Two air intake passages 12 are provided at two opposite lateral sides of the housing 1. Two vertical partition walls 13 are mounted inside the housing 1, defining an air accumulation chamber 14. An opening 131 is made at each vertical partition wall 13 which imparts a passage between the adjacent air intake passage 12 and the air accumulation chamber 14. A transverse frame 15 is disposed inside the air accumulation chamber 14 and spaced from the inside wall of the housing 1. A magnetic element 2 and a sterilizing lamp (for example, ultraviolet lamp) 3 are mounted inside the air accumulation chamber 14 above the transverse frame 15. The magnetic element 2 can be a magnet. An air intake chamber 16 is defined within the housing 1 below the transverse frame 15, and disposed in communication with the air accumulation chamber 14. An induction-draft fan 4 is mounted in the air intake chamber 16. The induced-draft fan 4 can be a cylindrical fan. An air output port 17 is provided at the bottom side of the air intake chamber 16.

Referring to FIG. 1 again, a plurality of air filters 5 are respectively mounted inside the housing 12 between the openings 131 of the vertical partition walls 13 and the air intake passages 12. Because outside air passes to the inside of the housing 1 through the air intake passages 12 and then flows into the air accumulation chamber 14 through the openings 131 of the vertical partition walls 13, it is filtered by the air filters 5 before passing to the air accumulation chamber 14.

Figure 4:
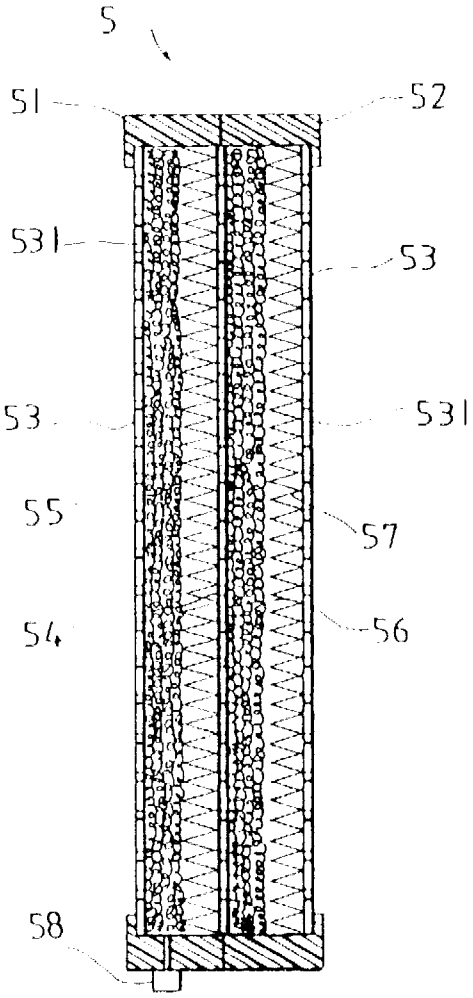
FIG. 4 is a sectional view of the air filter shown in FIG. 3.
Figure 3:
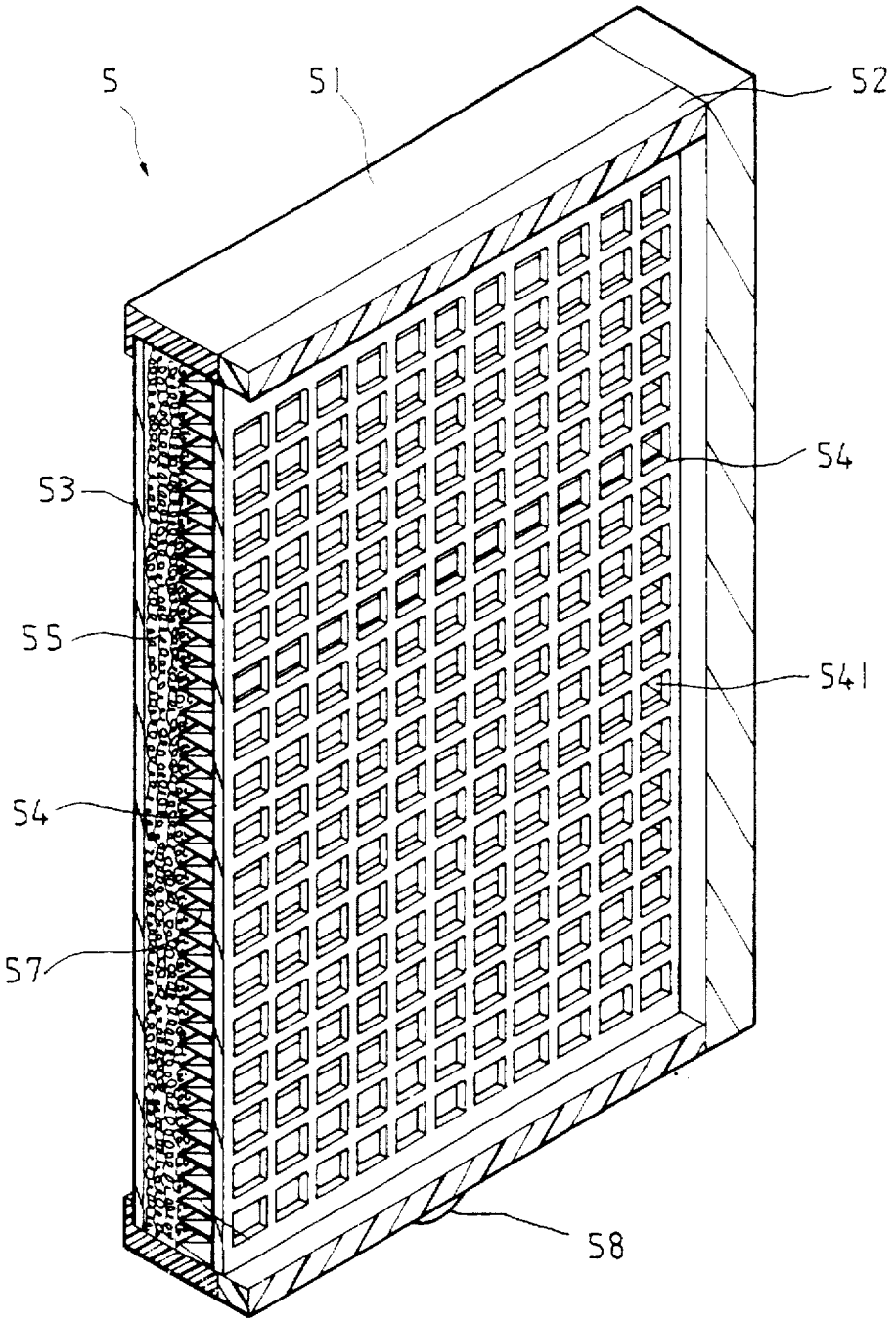
FIG. 3 is a broken view of an air filter according to the present invention.

Referring to FIGS. 3 and 4 and FIG. 1 again, each air filter 5 comprises a first electrically insulative frame 51 and a second electrically insulative frame 52 fastened together, two outer partition boards 53 respectively fastened to the insulative frames 51,52 at two opposite sides and having respectively a plurality of air vents 531, an intermediate partition board 54 spaced between the outer partition boards 53 and having a plurality of air vents 541, two metal filter elements for example a first metal wire gauze filter 55 and a second metal wire gauze filter 56 respectively mounted within the insulative frames 51,52 between the outer partition boards 53 and separated by the intermediate partition board 54, two electrically insulative wire gauze filters 57 mounted within the insulative frames 51,52 and respectively attached to the metal wire gauze filters 55,56 at one side, a metal spring plate 58 connected to the first metal wire gauze filter 55 and extended out of the corresponding frame 51. The wire gauze filters 55,56 are respectively made by first flattening stainless steel wires by ramming, then curling flattened stainless steel wires, and then fastening twisted flattened stainless steel wires together. The housing 1 further comprises a plurality of mounting grooves 18 adapted for receiving the air filters 5, and a plurality of metal contact plates 181 respectively mounted in the mounting grooves 18 at locations corresponding to the metal spring plates 58 of the air filters 5. The metal spring plates 58 are respectively connected to high-voltage positive static electricity 61 or high-voltage negative static electricity 62 of a high-voltage static electricity generator 6, which is mounted inside the housing 1. According to the preferred embodiment, the metal spring plates 58 are respectively connected to high-voltage positive static electricity 61 of the high-voltage static electricity generator 6, and the high-voltage negative static electricity of the high-voltage static electricity generator 6 is connected to the air output port 17 for producing negative ions.

Referring to FIG. 1 again, when outside air passes through the air passages 12 into the inside of the housing 1, it is filtered by the metal wire gauze filters 55,56 of the air filters 5, then filtered air passes through the openings 131 of the vertical partition wall 13 into the air accumulation chamber 14 in which filtered air is sterilized by the light of the sterilizing lamp 3, and then sterilized air is induced by the induced-draft fan 16 to pass over the transverse frame 15 into the air intake chamber 16 and then to be forced out of the air output port 17, and at the same time negative ions are carried with sterilized air out of the housing 1, and there purified air is supplied.

Because the first metal wire gauze filter 55 carries high-voltage positive static electricity, the second metal wire gauze filter 56 is induced to cause a static induction, therefore negative static electricity is produced at one side of the second metal wire gauze filter 56 adjacent to the first metal wire gauze filter 55, and positive static electricity is produced at the opposite side of the second metal wire gauze filter 56 remote from the first metal wire gauze filter 55. Therefore, dust either carrying positive electric charges or negative electric charges can be caught by the metal wire gauze filters 55,56. Further, the magnetic element 2 produces magnetic lines of force that cut through the flowing flow of air at right angles, causing air to obtain energy (similar to the production of electric energy of a conductor being moved in a magnetic field).

Figure 5:
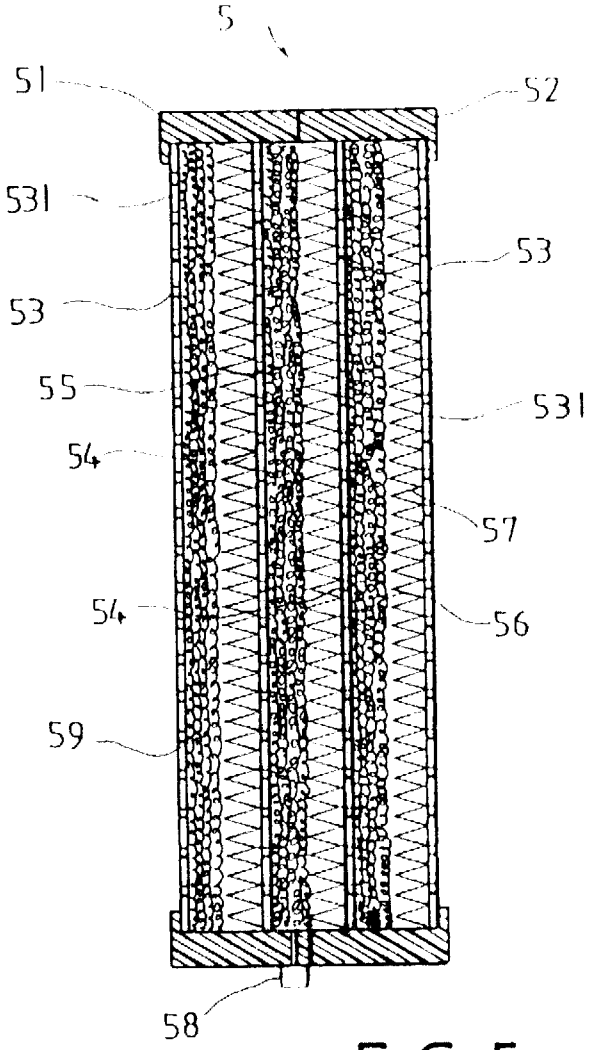
FIG. 5 is a sectional view of an alternate form of the air filter according to the present invention.

FIG. 5 shows an alternate form of the air filter 5. According to this alternate form, a third metal wire gauze filter 59 is spaced from the second metal wire gauze filter 56 at one side remote from the first metal wire gauze filter 55. When high-voltage positive static electricity is connected to the first metal wire gauze filter 55, the second metal wire gauze filter 56 and the third metal wire gauze filter 59 are induced to produce high-voltage positive static charges and high-voltage negative static charges at both sides.

It is to be understood that the drawings are designed for purposes of illustration only, and are not intended as a definition of the limits and scope of the invention disclosed.

What the invention claimed is:

1. An air purifier comprising:

a housing having two air intake passages at two opposite lateral sides thereof through which outside air passes to the inside of said housing, an air output port at a bottom side thereof, an air intake chamber communicating between said air intake passages and said air output port;

an induced-draft fan mounted in the air intake chamber of said housing and adapted to induce air from said air intake passages through said air intake chamber toward said air output port;

a plurality of air filters respectively mounted inside said housing and adapted to filter air passing from said air intake passages to said air intake chamber, each of said air filters comprising two electrically insulative frames fastened together, a first electrically conductive air filter element and at least one second electrically conductive air filter element spaced within said electrically insulative frames; and a high-voltage static electricity generator mounted inside said housing and connected to the first electrically conductive air filter element of each of said air filters;

wherein said high-voltage static electricity generator is controlled to provide high-voltage static electricity to said first electrically conductive air filter element, causing said at least one second electrically conductive air filter element to produce positive static electricity at one side and negative static electricity at an opposite side for catching dust from air passing through.

2. The air purifier of claim 1 wherein said housing has a flat structure and a face panel decorated with a design.

3. The air purifier of claim 1 wherein said housing comprises two vertical partition walls, an air accumulation chamber defined between said vertical partition walls, at least one opening disposed at each of said vertical partition walls and imparting a passage between said air intake passages and said air accumulation chamber, a transverse frame disposed inside said air accumulation chamber and adapted for guiding air from said air accumulation chamber to said air intake chamber.

4. The air purifier of claim 1 further comprising a magnetic element mounted inside said housing above said air intake chamber, said magnetic element producing magnetic lines of force that cut perpendicularly through air passing from said air intake passages to said air intake chamber, causing air to obtain energy.

5. The air purifier of claim 4 wherein said magnetic element is a magnet.

6. The air purifier of claim 1 further comprising a sterilizing lamp suspended above said air intake chamber and controlled to produce light for sterilizing air passing through said air intake chamber.

7. The air purifier of claim 1 wherein said induced-draft fan is a cylindrical fan.

8. The air purifier of claim 1 wherein said housing comprises a plurality of mounting grooves which receive said air filters.

9. The air purifier of claim 8 wherein said mounting grooves are respectively mounted with a respective metal spring plate, said metal spring plate being connected to high-voltage positive static electricity of said high-voltage static electricity generator; the first electrically conductive air filter element of each air filters is disposed in contact with the metal spring plate in the corresponding mounting groove.

10. The air purifier of claim 1 wherein said first and at least one second electrically conductive air filter elements are respectively made by first flattening stainless steel wires by ramming, then curling flattened stainless steel wires, and then fastening twisted flattened stainless steel wires together to form a metal wire gauze filter.

11. The air purifier of claim 1 wherein said first and at least one second electrically conductive air filter elements are wire gauze filters formed of active carbon.

12. The air purifier of claim 1 wherein each of said air filter further comprises a plurality of electrically insulative plastic wire gauze filters mounted within its electrically insulative frames and respectively separated by its first and at least one second electrically conductive air filter elements.

13. The air purifier of claim 12 wherein said electrically insulative plastic wire gauze filters are made from nylon.

14. The air purifier of claim 1 wherein each of said air filters comprises two electrically insulative frames fastened together, a first electrically conductive air filter element and two second electrically conductive air filter elements spaced from two opposite sides of said first electrically conductive air filter element within said electrically insulative frames.

15. The air purifier of claim 1 wherein said high-voltage static electricity generator is controlled to provide high-voltage negative static electricity to said first electrically conductive air filter element, causing said at least one second electrically conductive air filter element to produce high-voltage positive static charges at one side adjacent to said first electrically conductive air filter element.

16. The air purifier of claim 1 wherein said high-voltage static electricity generator is controlled to provide high-voltage positive static electricity to said first electrically conductive air filter element, causing said at least one second electrically conductive air filter element to produce high-voltage negative static charges at one side adjacent to said first electrically conductive air filter element.

17. The air purifier of claim 1 wherein said high-voltage static electricity generator provides high-voltage positive static electricity to said the first electrically conductive air filter element of each of said air filters, and high-voltage negative static electricity to said air output port.

* * * * *